United States Patent [19]

Paürat et al.

[11] Patent Number: 4,610,573

[45] Date of Patent: Sep. 9, 1986

[54] TUNNELING MACHINE

[76] Inventors: Friedrich W. Paürat, Kasselweg 29, 4230 Wesel 1; Roland Paürat, Blumenstrasse 11, 4230 Wesel 13, both of Fed. Rep. of Germany

[21] Appl. No.: 761,571

[22] Filed: Aug. 1, 1985

[30] Foreign Application Priority Data

Aug. 1, 1984 [DE] Fed. Rep. of Germany ..... 3428358

[51] Int. Cl.[4] ..... E21D 20/00

[52] U.S. Cl. ..... 405/259; 405/146; 405/303; 299/33

[58] Field of Search ..... 405/146, 303, 259; 299/33, 43, 45; 175/219, 220

[56] References Cited

U.S. PATENT DOCUMENTS

| | | | |
|---|---|---|---|
| 4,098,538 | 7/1978 | Hilton | 299/33 |
| 4,199,193 | 4/1980 | Pamron et al. | 299/33 |
| 4,226,476 | 10/1980 | Fairchild et al. | 299/33 |
| 4,297,057 | 10/1981 | O'Neil | 405/303 |

FOREIGN PATENT DOCUMENTS

| | | | |
|---|---|---|---|
| 3334975 | 4/1984 | Fed. Rep. of Germany | 405/303 |

*Primary Examiner*—Cornelius J. Husar

*Assistant Examiner*—Douglas W. Hanson

*Attorney, Agent, or Firm*—Karl F. Ross; Herbert Dubno

[57] ABSTRACT

A tunneling machine according to the invention has a mobile and automotive base movable on the ground horizontally and longitudinally toward a face to be cut away, a turntable on the base defining an upright pivot axis and having a main support pivotal about the axis on the base, an arm having an inner end pivotal about a horizontal axis on the main support and having an outer end, and a cutter on the outer end of the arm. A conveyor having an intake on the ground between the base and the cutter and extends back away from the face, normally through the base. Actuators connected between the cutter, arm, support, conveyor, and base move the cutter over the face to cut rock therefrom and convey the cut rock back away from the face. A drilling apparatus including a drilling unit for making a hole extending along a bore axis and another unit for setting a rockbolt in the hole thus drilled is carried on the arm and engageable with the ceiling immediately adjacent the face. The cutter is engageable with the floor to support the arm thereon while the drilling apparatus is boring in the ceiling.

7 Claims, 6 Drawing Figures

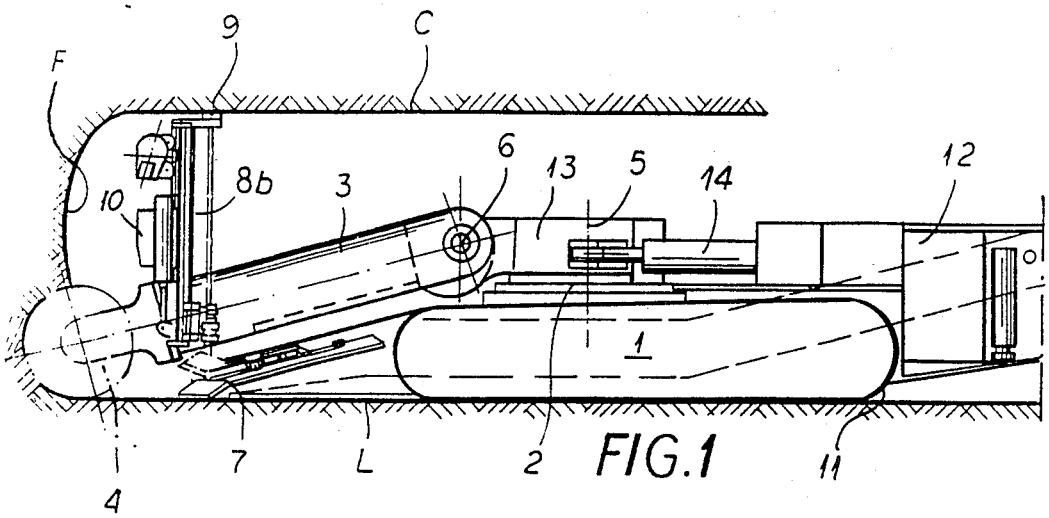
FIG.1
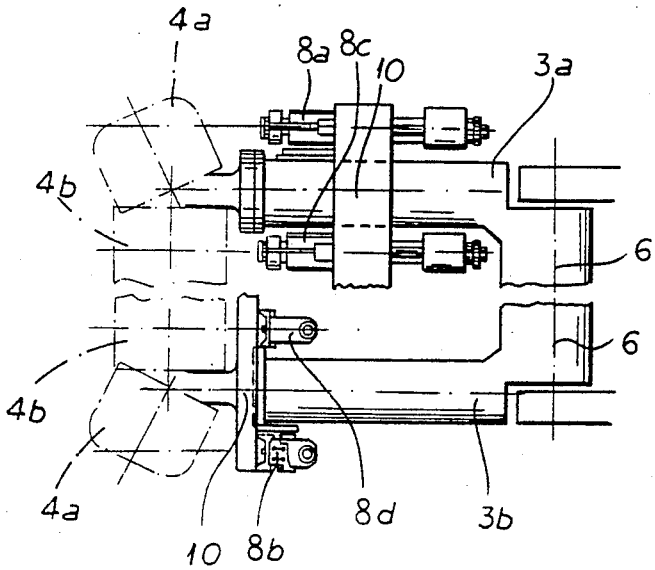
FIG.2B
FIG 2A
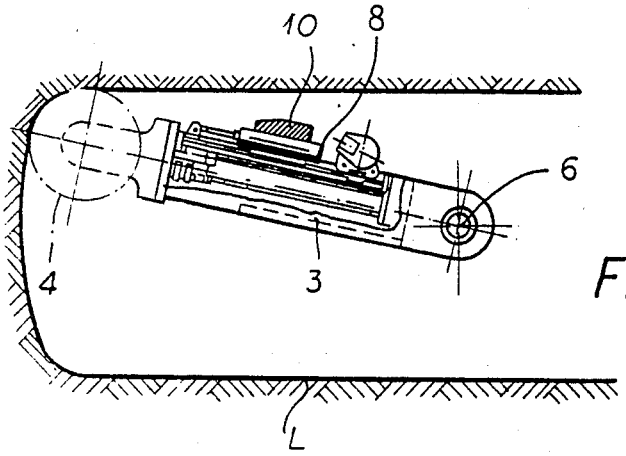
FIG.3

TUNNELING MACHINE

FIELD OF THE INVENTION

The present invention relates to a tunneling machine. More particularly this invention concerns such a machine that not only drives a horizontal tunnel, but that also is equipped to stabilize the rock face thus exposed.

BACKGROUND OF THE INVENTION

A standard tunneling machine has an automotive base typically provided with a track drive and having a turntable defining a vertical axis about which a main support is pivotal. This automotive base has a diesel engine that serves principally to pressurize hydraulic fluid used by all the motors and actuators of the machine. A cutter is carried at the front end of an arm having a back end pivoted about a horizontal axis on the main support, and the cutter may be tippable about the longitudinal axis of the arm also. A conveyor rides on the ground immediately behind the cutter to take in and conduct the rock ground from the face by the cutter back past the automotive machine base.

Such a machine drives a tunnel by cutting away the end face of the tunnel and conveying it back out of the way. The cutter is moved up and down and from side to side to make the tunnel whatever width and height are required.

As the tunnel is driven it is necessary to stabilize the tunnel walls, principally the roof. This is done by drilling deep blind holes in the wall, anchoring long rock bolts in them with an epoxy mixture and/or an expansion sleeve, and then pulling large fishplate washers against the face with nuts threaded over the projecting ends of the bolts. In this manner the rock of the wall, even if it has been loosened as the tunnel was driven, is secured solidly together and to the overlying undisturbed rock, greatly reducing likelihood of a cave-in.

The stabilizing or bolting apparatus, which normally comprises a drilling unit and a bolt-setting unit, is typically driven by the engine on the tunneling-machine base. In German Pat. document No. 3,334,975 each side of the base of the machine is provided with a bolting apparatus that can be maneuvered by respective actuators for three-dimensional movement. Thus quite some extra equipment, normally at least three double-acting hydraulic rams, must be provided for each drilling unit, considerable increasing the cost of the machine and the difficulty of controlling it.

Although the top of the drilling apparatus can move over quite some arc, it is still impossible to plant a bolt directly over the middle of the tunnel. The inner bolts must normally be set at an angle, and only the bolts set directly above the sides of the machine will be vertical and perpendicular to the face, which is the most effective position. What is more, with such an apparatus it is impossible to stabilize the tunnel roof until quite some time after it is excavated, that is long enough for the tunneling machine to have advanced the several meters from the cutter to the bolting devices. This unstabilized roof can therefore cave in onto the cutting machine, and generally creates a danger, particularly as it is immediately adjacent an area where the cutter is doing considerable violence to the rock.

OBJECTS OF THE INVENTION

It is therefore an object of the present invention to provide an improved tunneling and stabilizing machine.

Another object is the provision of such a tunneling and stabilizing machine which overcomes the above-given disadvantages, that is which is simple to operate, which can set bolts anywhere on the tunnel roof, and which can work fairly close behind the cutter.

SUMMARY OF THE INVENTION

A tunneling machine according to the invention has a mobile and automotive base movable on the ground horizontally and longitudinally toward a face to be cut away, a turntable on the base defining an upright pivot axis and having a main support pivotal about the axis on the base, an arm having an inner end pivotal about a horizontal axis on the main support and having an outer end, and a cutter on the outer end of the arm. A conveyor having an intake on the ground between the base and the cutter and extends back away from the face, normally through the base. Actuators connected between the cutter, arm, support, conveyor, and base move the cutter over the face to cut rock therefrom and convey the cut rock back away from the face. A drilling apparatus is carried on the arm and engageable with the ceiling immediately adjacent the face. The cutter is engageable with the floor to support the arm thereon while the drilling apparatus is boring in the ceiling.

The drilling apparatus according to this invention includes a drilling unit for making a hole extending along a bore axis and another unit for setting a rockbolt in the hole thus drilled.

With this arrangement, therefore, the various actuators that control the cutter arm are used to manipulate the drilling apparatus also. Thus the operator can use the same controls in about the same manner to move the drilling apparatus into place. There is no need for a separate set of actuators or controls, and the operator can use the skills gained in operating the cutter to manipulate the stabilizing gear. In addition since this equipment is provided on the arm, it can stabilize the ceiling immediately adjacent the new face, well ahead of the machine and its operator. In use the face is cut away somewhat by the cutter, then the holes drilled and bolts planted, then the entire machine advances to work on a new spot.

According to another feature of this invention the drilling apparatus is elongated and is displaceable on the arm between a use position extending upward therefrom and a park position extending out of the way along the arm. Thus a single fairly simple actuator is all that need be provided for the drill. The operator need merely drop down the arm and raise the actuator, to be in a position to swing the arm to wherever along the face a bolt is to be installed, and then drill and set the bolt. During the drilling and setting operation the cutter lies directly on the ground, providing stable support for the drill and setter.

In accordance with further features of the invention the arm is U-shaped toward the face and has two parallel and transversely spaced sides each having one such outer end. The cutter transversely bridges the outer ends and each side carries one such drilling apparatus. A transverse beam interconnecting and carrying the two drilling apparatuses is pivotal between the use and park positions. In fact four drills can be provided to simultaneously bore four holes for four bolts, making the stabilizing operation go very quickly.

DESCRIPTION OF THE DRAWING The above and other features and advantages will become more readily apparent from the following, reference being made to the accompanying drawing in which:

FIG. 1 is a side view of the tunneling machine according to this invention with the cutter down and the bolting apparatus up;

FIGS. 2A and 2B are partial top views of the machine, with the bolting apparatus respectively in the up and down positions;

FIG. 3 is a partial side view showing the cutter raised and the bolting apparatus parked;

SPECIFIC DESCRIPTION

Figure 4:
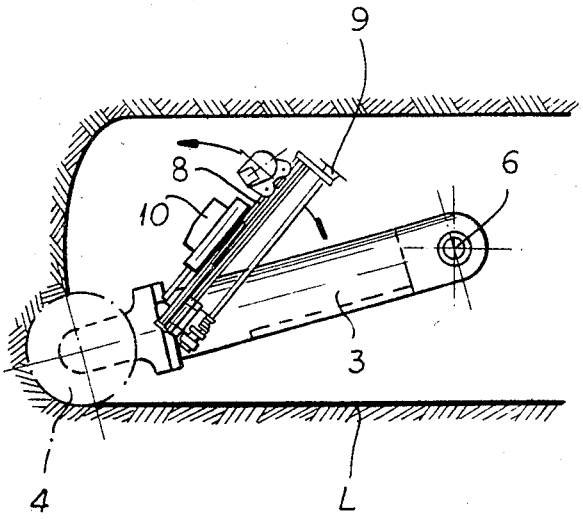
FIG. 4 is a partial side view showing the cutter down and the bolting apparatus partly raised.

As seen in FIG. 1 an automotive base 1 provided with a caterpillar drive 11 and having a diesel engine 12 can move underneath the ceiling C along the floor L of a tunnel toward a face F to be cut away. The base 1 has a turntable 2 defining an upright axis 5 for a main support 13 that can be pivoted on the base 1 about this axis 5 by a double-acting hydraulic ram 14 powered from the engine 12. A cutter arm 3 has an outer end carrying a cutter formed by two outside angled drums 4*a* (FIGS. 2A and 2B) and a central drum 4*b*, and an inner end pivotal about a horizontal axis 6 on the support 13. Another double-acting cylinder like the cylinder 14 can pivot the arm between the lower position illustrated in FIGS. 1, 4, and 5 and the upper position of FIG. 3. Further means may be provided to pivot the cutter 4 on the arm 3 about the longitudinal axis of the arm 3 perpendicular to the axis 6, and to also move the cutter 4 limitedly along this axis by telescoping the arm 3 somewhat.

The arm 3 is actually U-shaped as shown in FIGS. 2A and 2B, having legs or sides 3*a* and 3*b*, one of which houses the drive motor for the cutter 4 and that are transversely spaced. In addition a conveyor 7 starts at the floor L immediately behind the cutter 4 and extends back through the base 1 to carry away rock cut from the face F.

Figure 5:
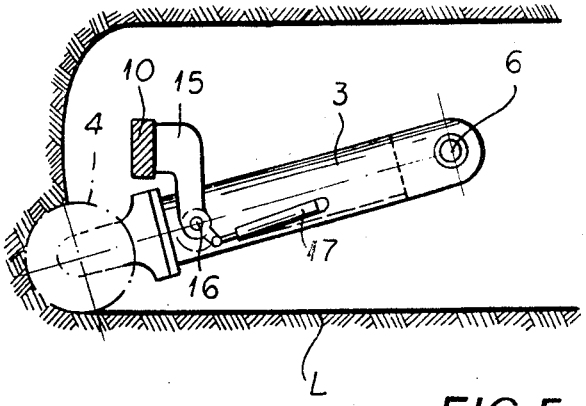
FIG. 5 is a partial view showing the cutter down and the support for the bolting apparatus fully raised, but the bolting apparatus itself is omitted for clarity of view.

According to this invention a transverse beam 10 is carried on a pair of arms 15 (FIG. 5 only) and can be pivoted about an axis 16 parallel to the axis 6 by another actuator 17 between a use position shown in FIGS. 1, 2A, and 5 and an out-of-service or park position shown in FIGS. 2B and 3, and through an intermediate position shown in FIG. 4. This beam carries four drilling and and bolt-setting devices 8*a*, 8*b*, 8*c*, and 8*d*, two at each leg 3*a* and 3*b* of the arm 3. Each of these devices 8*a*–8*d* has an upper end 9 engageable with the ceiling C immediately adjacent the face F.

The machine according to this invention tunnels in the conventional manner by sweeping the cutter 4 up and down and back and forth to cut away the face F, normally with the base 1 stationary. The horizontal and vertical extent of the sweep is determined by how large the tunnel is to be, and whether it is to be level, rise, or sink. The conveyor 7 catches the thus freed rock and/or ore and conveys it back from the face F. During such cutting the drilling and setting units 8*a*–8*d* are parked lying down as shown in FIG. 2B and 3. In this position the beam 10 lies on the legs 3*a* and 3*b* and the units 8*a*–8*d* themselves are in the same plane as these legs 3*a* and 3*b*, wholly out of the way. The modest extra weight added by this structure to the arm 3 is inconsequential since the actuators that move it are very powerful to thrust the cutter 4 forcibly into the rock.

Once the face F has been cut away as far as the cutter 4 can reach, the cutter 4 is dropped all the way down as shown in FIG. 4 so its sits on the ground, and the beam 10 with the units 8*a*–8*d* are pivoted into the raised position of FIGS. 1 and 2A. Four holes are then drilled in the ceiling C and respective rock bolts are set in them. Thus the ceiling C is stabilized immediately adjacent this face F, and bolts can be applied at the very center of the new tunnel, where they are most needed.

Thereafter the beam 10 is parked again and the base 1 advanced to make a new cut.

We claim:

1. A tunneling machine comprising:

a mobile and automotive base movable on the ground horizontally and longitudinally toward a face to be cut away;

a turntable on the base defining an upright pivot axis and having a main support pivotal about the axis on the base;

an arm having an inner end pivotal about a horizontal axis on the main support and having an outer end;

a cutter on the outer end of the arm;

a conveyor having an intake on the ground between the base and the cutter and extending back away from the face;

means including actuators connected between the cutter, arm, support, conveyor, and base for moving the cutter over the face to cut rock therefrom and for conveying the cut rock back away from the face;

a drilling apparatus carried on the arm and engageable with the ceiling immediately adjacent the face, the cutter being engageable with the floor to support the arm thereon while the drilling apparatus is boring in the ceiling.

2. The tunneling machine defined in claim 1 wherein the drilling apparatus includes means for drilling a hole along a bore axis and means for setting a rockbolt in the hole thus drilled.

3. The tunneling machine defined in claim 2 wherein the drilling apparatus is elongated and is displaceable on the arm between a use position extending upward therefrom and a park position extending out of the way along the arm.

4. The tunneling machine defined in claim 3 wherein the arm is U-shaped toward the face and has two parallel and transversely spaced sides each having one such outer end, the cutter transversely bridging the outer ends, each side carrying one such drilling apparatus.

5. The tunneling machine defined in claim 4, further comprising a transverse beam interconnecting and carrying the two drilling apparatuses and pivotal between the use and park positions.

6. The tunneling machine defined in claim 1 wherein the drilling apparatus has an upper end engageable with the ceiling.

7. A tunneling machine comprising:

a mobile and automotive base movable on the ground horizontally and longitudinally toward a face to be cut away;

a turntable on the base defining an upright pivot axis and having a main support pivotal about the axis on the base;

an arm having an inner end pivotal about a horizontal axis on the main support and having an outer end;

a cutter on the outer end of the arm;

a conveyor having an intake on the ground between the base and the cutter and extending back away from the face;

means including actuators connected between the cutter, arm, support, conveyor, and base for moving the cutter over the face to cut rock therefrom and for conveying the cut rock back away from the face;

a drilling apparatus including means for drilling a hole along a bore axis and means for setting a rockbolt in the hole thus drilled is pivotal on the arm between a use position projecting upwardly therefrom and engageable with the ceiling and a park position lying therealong and out of the way, the cutter being engageable with the floor to support the arm thereon while the drilling apparatus is boring in the ceiling.

* * * * *